United States Patent [19]

Pedersen

[11] Patent Number: 4,513,920

[45] Date of Patent: Apr. 30, 1985

[54] WINDING MACHINE FOR WINDING ELONGATE MEMBERS OR CORES

[75] Inventor: Jan B. Pedersen, Bredsten, Denmark

[73] Assignee: Tortrix A/S, Vejle, Denmark

[21] Appl. No.: 407,959

[22] Filed: Aug. 13, 1982

Related U.S. Application Data

[63] Continuation-in-part of Ser. No. 174,496, Nov. 9, 1979, abandoned.

[51] Int. Cl.[3] ..... H01F 41/08

[52] U.S. Cl. ..... 242/4 B

[58] Field of Search ..... 242/4 B, 4 BE, 4 R, 242/5

[56] References Cited

U.S. PATENT DOCUMENTS

| | | | |
|---|---|---|---|
| Re. 17,559 | 1/1930 | Pullets | 242/4 BE |
| 2,793,817 | 5/1957 | Clarke | 242/4 B |
| 2,923,485 | 2/1960 | Fordeck | 242/4 B |
| 2,974,890 | 3/1961 | Davis | 242/4 B |
| 3,662,965 | 5/1972 | Havasi et al. | 242/4 B |
| 3,764,082 | 10/1973 | Gorman | 242/4 B |
| 3,848,819 | 11/1974 | Fukushima | 242/4 B |
| 4,399,950 | 8/1983 | Pedersen | 242/4 B |

FOREIGN PATENT DOCUMENTS

| | | | |
|---|---|---|---|
| 409352 | 2/1925 | Fed. Rep. of Germany . | |
| 542225 | 12/1941 | United Kingdom | 242/4 B |
| 684472 | 12/1952 | United Kingdom | 242/4 B |
| 770545 | 3/1957 | United Kingdom . | |
| 789434 | 1/1958 | United Kingdom | 242/4 B |

*Primary Examiner*—Billy S. Taylor

*Attorney, Agent, or Firm*—Schwartz, Jeffery, Schwaab, Mack, Blumenthal & Koch

[57] ABSTRACT

In a double-ring winding machine for winding of wire on closed core members such as toroidal cores comprising a wire magazine and an annular wire advancing member arranged concentrically to rotate about the same axis independent of each other, the wire magazine has an internal diameter exceeding the external diameter of the wire advancing member and the wire magazine and the wire advancing member are suspended in mutual radial alignment throughout their axial width. Wire is drawn out from the wire magazine through a bottom slit and guided through a hole in the wire advancing member during rotation of both and simultaneously wire is filled into the magazine through an opening in the external side thereof. The filling opening may have the form of a slit opposite the bottom slit whereby the wire magazine may be composed of two rings of semi-circular cross-section separated by the bottom and filling slits only, both of which may be wave-formed in the longitudinal direction.

12 Claims, 10 Drawing Figures

27'
12
30
27
31
18
11
20
15
19
17
16
21

WINDING MACHINE FOR WINDING ELONGATE MEMBERS OR CORES

This application is a continuation-in-part of my now abandoned copending U.S. patent application Ser. No. 174,496, filed Nov. 9, 1979 as a national stage application on my International patent application No. PCT/DK79/00008, filed Mar. 13, 1979 "and my copending U.S. patent application Ser. No. 269,017, filed May 13, 1981, now U.S. Pat. No. 4,399,950, as a national stage application on my International patent application No. PCT/DK80/00057, filed Sept. 18, 1980."

BACKGROUND OF THE INVENTION

The invention relates to a winding unit with a wire magazine for use in a winding machine, particularly for the winding of wire on elongate particularly closed core members, such as toroidal cores.

In existing machines for the winding of toroidal cores, primarily with wire-shaped material, winding units with magazines are used which are mainly of the following kinds:

(1) The coil magazine type,
(2) The tubular magazine type,
(3) The double ring type,
(4) The single ring type,
(5) The bandaging type.

In winding units of the coil magazine type such as known, e.g. from German published specification DE-AS No. 1 228 719, the coil magazine moves in a circular path around the member to be wound ahd rotates simultaneously around its own axis. The disadvantages of this construction are that the winding material must be coiled into the coil magazine in a preceding operation, and that the supply capacity is limited relative to the dimensions of the circular path on one hand, and of the member to be wound on the other hand. In the winding of toroidal cores, whether they are open or endless, the coil magazine and thereby the supply capacity will be limited by the hole of toroidal core which is also a disadvantage.

In the tubular magazine type such as known e.g. from U.S. Pat. No. Re. 17,559, a tube is used which is bent into a circular ring in which the winding material is forming a spiral. During the winding operation the ring is rotating in its own plane around its own centre and around the member to be wound. The disadvantage of this construction is that the winding material must be twisted and pushed into the tube by means of special apparatus in a preceding operation.

A winding unit of the double ring type such as known from British Patent Specification No. 660 218, consists of an advancing ring and a magazine ring. The two rings have nearly the same diameter and a common axis of revolution. The disadvantage of this construction is that the two rings must first perform an interlocked rotary movement when positioning the winding material on the magazine ring whereafter the interlocking engagement is interrupted, the direction of rotation is reversed, and the winding may take place in a manner analogous to the two above mentioned methods. The fact, that in the double ring type the cross-sectional area is increased relative to that of the tubular magazine type due to the advancing ring, implies that the minimum value of the hole in toroidal cores, whether they are open or endless, will be increased.

In the single ring type such as known e.g. from U.S. Pat. No. 3,662,965 an endless ring is used having a U-shaped cross-section, said ring being provided with a lateral slide.

The disadvantage of this type is that the ring must first rotate a number of revolutions for positioning the winding material on the magazine whereafter the direction of rotation is reversed, and the winding may take place via the lateral slide in a manner analogous to the double ring type. In toroidal cores, whether they are open or endless, the winding plane will be displaced from the centre of the hole, whereby the wire consumption will increase. Furthermore, the minimum value of the hole of the toroidal core will be increased with the thickness of the lateral slide.

The bandaging machine is used to cover a finished winding with a strip-shaped insulating foil. Such a machine may have a magazine comprising two identical rings between which cylindrical rollers are closely arranged. In a machine disclosed in German published specification DE-OS No. 2 427 588 it has been attempted to use this principle for wire winding. When applied for wire winding the principle has two essential disadvantages. On one hand, the residual hole in the toroidal core will be great, since the wire supply is carried by the extreme part of the rollers having a flange only. On the other hand, due to the fact that the individual cylinders with flanges are rolling during the winding operation, a great friction will arise between the wire supply and the flange, and the wire will break if more than one wire layer is filled into the magazine.

Moreover, it is common to the magazine types described that the wire tension during the winding operation is provided by means of a friction brake. This type of brake can only act to increase the nominal level of wire tension without changing the variation range of the wire tension.

Some of the above-mentioned disadvantages are avoided in a winding machine of the single ring type disclosed in U.S. Patent Specificaion No. 2,974,890 in which the wire magazine is filled with winding wire in the same operation as the winding of a core by taking out the winding wire through a slit in the bottom of the wire magazine, i.e. the side facing the axis of revolution. However, in this prior art construction the need of accessability of the magazine from the external side results in a relatively open magazine in which no precautions have been taken for controlling the wire supply remaining in the magazine after cutting of the wire. Therefore, it will be necessary to fill wire into the magazine continouously to the end of the winding operation and, if the magazine should have a reasonable wire collecting capacity a considerable surplus of wire will be left in the magazine after completion of the winding operation and will get lost unless it is rewound from the magazine.

In another prior art winding machine disclosed in German Patent Specification No. 409,352 in which an open wire magazine is used having a very limited filling capacity the latter drawback is eliminated by fixing the free end of the wire relative to the magazine after cutting which requires, however, that rotation of the magazine is stopped momentarily.

SUMMARY OF THE INVENTION

It is the object of the present invention to provide a winding unit for winding machines of the double ring type, i.e. having a wire magazine and a wire advancing member concentric therewith, which operates in the same manner as the above-mentioned prior art machines in that winding wire is filled into the magazine continuously with the winding operation, but in which a great filling capacity of the magazine is obtained with safe control of the wire supply in the magazine and of the wire drawn out from the magazine after cutting of the wire, so that the wire may be cut as soon as a sufficient supply has been loaded into the magazine and without stopping rotation of the magazine in order to fix the free end of the wire.

According to the invention there is provided a winding unit for use in a winding machine for the winding of wire on elongate, particularly closed core members, such as toroidal cores.

The winding unit includes a suspension means for supporting a core member for rotational movement in a first plane. The unit also includes a substantially annular wire advancing member and a drive coupled with the wire advancing member.

An individual bearing suspends the wire advancing member for rotational movement in a prescribed direction of revolution around its own axis in a plane substantially normal to the first plane and with a substantially circular path of movement encircling the core member.

A substantially annular wire magazine of a generally U- or O-shaped cross-section provides a storage space for taking up wire from an external supply. The magazine has cross-sectional width and height dimensions considerably exceeding the diameter of the wire. The wire magazine has an internal side forming the bottom of the storage space and an external side providing an opening for filling wire into the storage space. The internal side has a diameter exceeding the external diameter of the wire advancing member. A second individual bearing suspends the wire magazine coaxially with the wire advancing member with the internal side of the wire magazine extending in radial alignment with an external side of said wire advancing member throughout the axial width of the wire magazine or said wire advancing member.

The individual bearings allow the wire magazine to follow the rotational movement of said wire advancing member in the prescribed direction, but be independent of the movement of the wire advancing member.

A bottom slit is formed in the internal side of the wire magazine throughout the circumferential length thereof with an opening facing the axis for drawing out wire from said storage space simultaneously with the filling of wire into the storage space through the opening in said external side of the wire magazine.

A wire guide is formed on the wire advancing member in substantial radial alignment with the bottom slit.

By this cross-sectional configuration of the wire magazine a relatively great wire supply may be filled into the magazine which will be suitable even for great wire diameters and the wire may be cut as soon as the magazine has been sufficiently filled without interrupting rotation of the magazine which continues with the remaining wire supply being safely held in the magazine and prevented from escaping at the external side thereof. During the whole operation the wire is drawn out via a stationary well-defined point.

Moreover, the design of the wire magazine with an internal diameter exceeding the external diameter of the wire advancing member together with suspension of the wire magazine and the wire advancing member in mutual radial alignment throughout their axial width will result in small overall cross-sectional dimensions of the wire magazine and the wire advancing member which form the rotating parts passing through the hole in the core being wound. Thereby a winding can be produced leaving the smallest possible residual hole in the core.

According to a modification of the invention, considerably improved characteristics of the winding unit may be obtained by means of a wire magazine comprising two annular halves, each of which is composed of two semi-annular parts separated by joining faces and formed with thin walls having a substantially semi-circular cross-sectional form to provide a substantially closed storage space, said two halves being separated, in addition to said bottom slit by an opposite wire filling slit only, said bottom slit being defined by edge portions of said two halves having walls, the surfaces of which deviate from a planar parallel relationship to the symmetry plane of the wire magazine normal to the axis of revolution. By designing the magazine halves in the manner indicated as thin-walled shells of semi-circular cross-sectional form, the best possible residual hole condition is obtained, since only the small thickness of the magazine walls will be added to the cross-sectional area of the wire supply.

Moreover, the substantially closed form secures efficiently holding of the wire supply in the magazine after cutting of the wire without any demands being made to a special design of driving or braking means or to use of particular members for closing the magazine. In addition, the closed design results in considerable advantages with respect to safety of labour.

Furthermore, by the indicated design of the bottom slit, a considerably improved security against slipping of the wire during drawing is obtained even with the winding object positioned excentrically relative to the magazine and an optimum possibility for correct control of the friction between the wire and the walls of the bottom slit and, thereby, of the wire tension.

BRIEF DESCRIPTION OF THE DRAWINGS

In the following the invention will be explained in further detail with reference to the accompanying schematic drawings in which.

DETAILED DESCRIPTION

Figure 1:
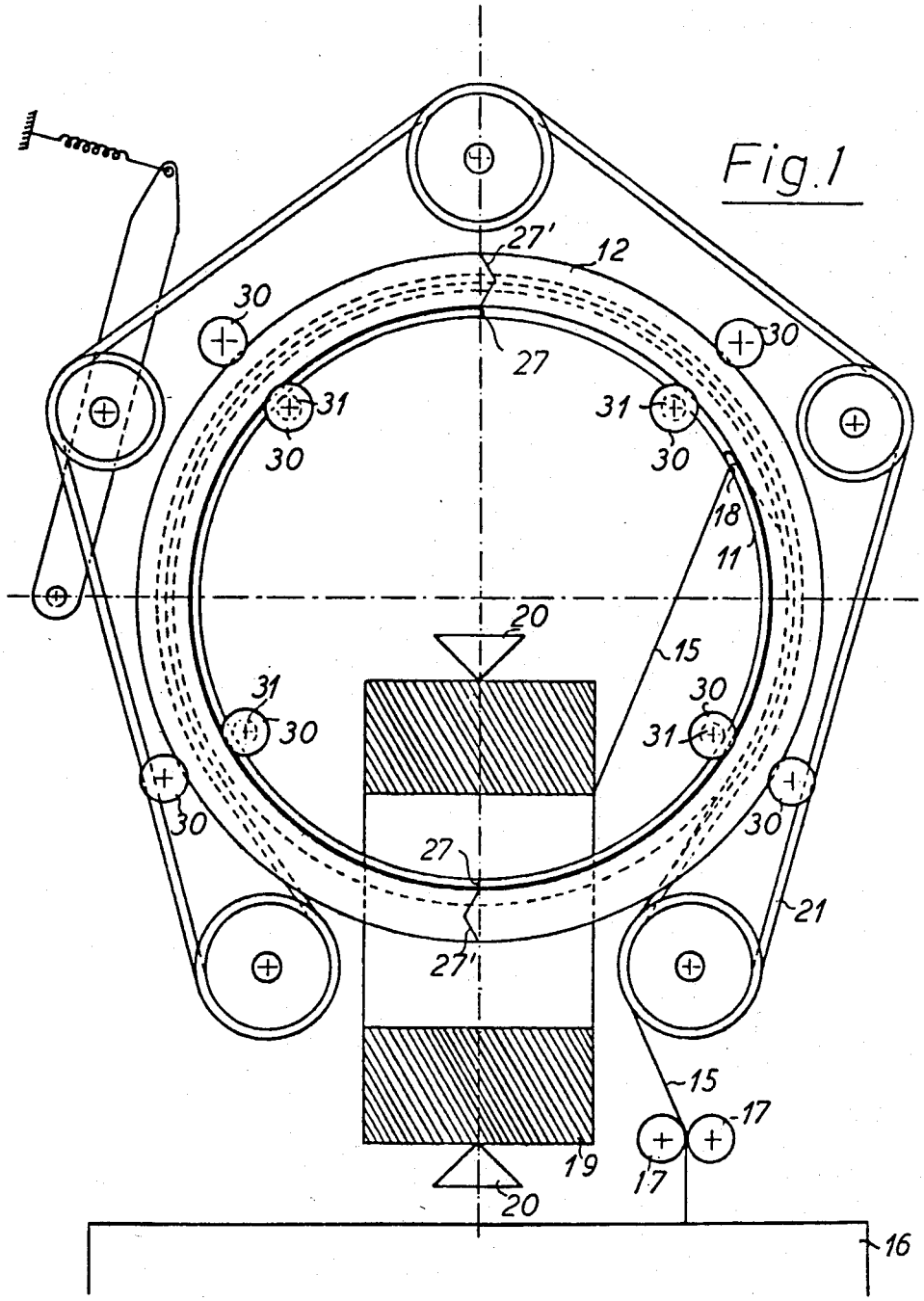
FIG. 1 shows first embodiment of a winding unit according to the invention.
Figure 2:
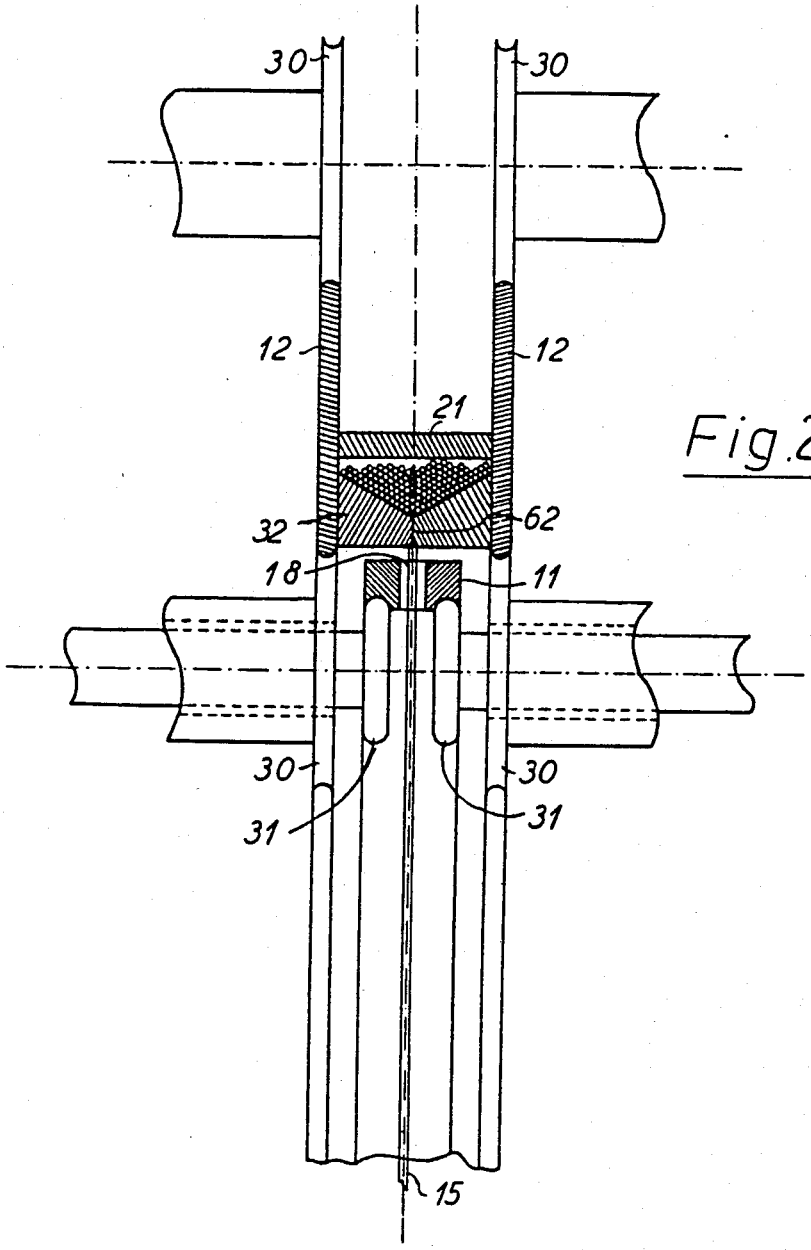
FIG. 2 is a cross-sectional view of the winding unit shown in FIG. 1.

In FIG. 1 a winding unit is shown comprising a wire advancing member 11 and a wire magazine 12, which may rotate freely relative to each other with the aid of individual bearing devices 30 and 31, respectively, as shown in FIG. 2. The rotation of the advancing member 11 is caused by driving means in the form of gears or friction wheels arranged to engage the advancing member 11 in connection with at least one of the four bearing devices 30, 31 shown in FIG. 1. The wire material 15 is carried from a supply 16 outside the winding unit through guide members 17 to the wire magazine 12 from which it is guided further on to the core 19 to be wound through a bottom slit 62 of the wire magazine 12 and the advancing member 11 which is constituted by a ring in which a hole 18 is formed to provide wire guide means in substantial radial alignment with the bottom slit 62 of the wire magazine 12. The free end of the wire material is held against the core 19, and when the advancing member 11 and thereby the wire guide hole 18 is caused to rotate, the wire 15 will be carried around the core 19 and, simultaneously, wire will be filled into the wire magazine 12. In order to position the windings correctly on the core 19 the latter and the winding unit must be displaced relative to each other during the winding operation. This may take place in a conventional manner with the aid of supporting means 20 for the core 19. As shown in FIG. 2 a braking device 21 in the form of a belt encircling the wire magazine 12 on part of its circumference and engaging the wire magazine will act to hold the supply of wire 15 in the magazine 12 after cutting of the wire. The wire magazine 12 comprises two symmetric rings,and the wire advancing member 11 is positioned below the two rings of the wire magazine 12 in radial alignment therewith throughout the axial width of the wire advancing member, whereby the contribution of the wire advancing member to the overall cross-sectional dimensions of the rotating parts of the winding unit passing through the core will be kept at a minimum.

As shown in FIG. 1, the wire advancing member 11 and the wire magazine are each divided into sectors with junctions 27 and 27′, respectively, so that they may be opened for the arrangement of endless toroidal cores.

As shown in FIG. 2 the slit 62 in the bottom of the wire magazine 12 through which the wire is drawn out from the magazine may be formed by rubber lips 32.

Figure 3:
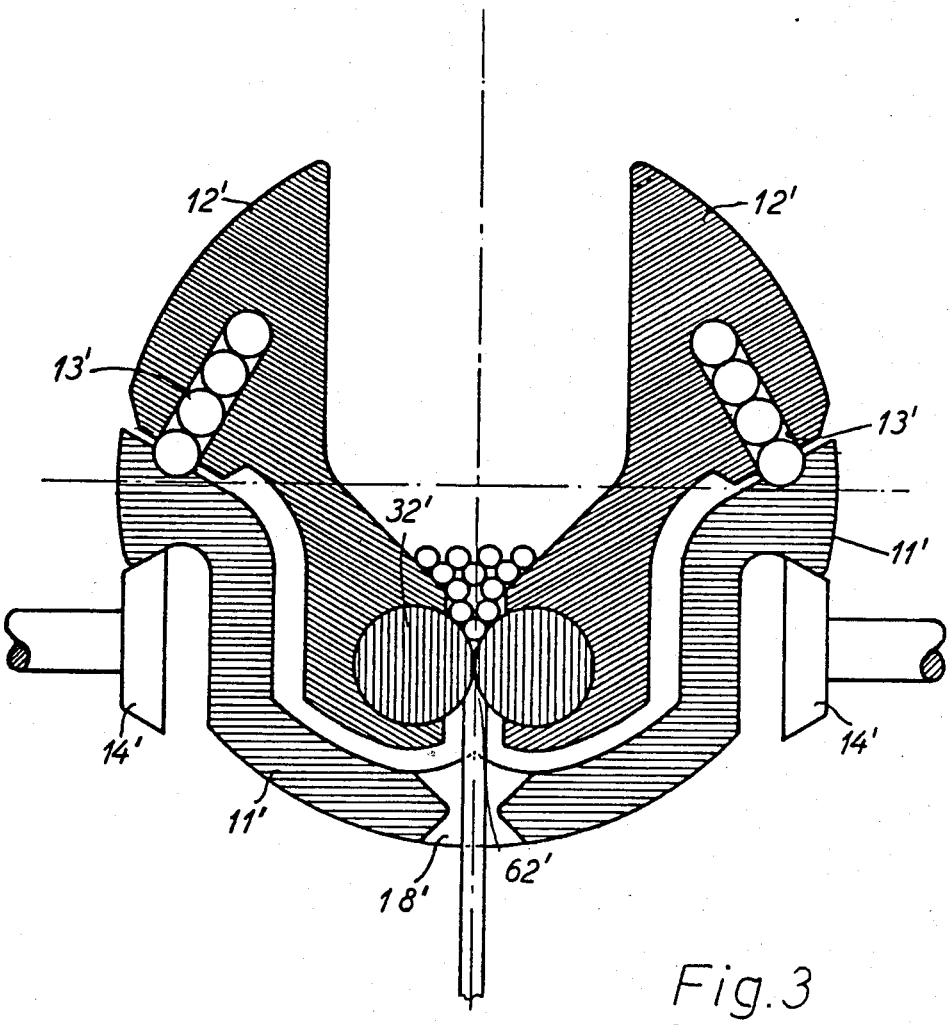
FIG. 3 is a cross-sectional view of a further embodiment.

In FIG. 3 an alternative embodiment of the winding unit is shown. The figure shows a practical embodiment of a magazine 12′ having a substantially circular cross-section so that the residual hole in a wound toroidal core will have the same size as the cross-section of the magazine 12′ and the advancing ring 11′ together. In this embodiment bearing means are provided in the form of ball bearings between ball races formed in opposing surface portions of the wire magazine 12′ and the wire advancing member 11′.

A bottom slit 62 for the wire magazine 12′ is limited by resilient rubber lips 32′.

A hole 18′ in the wire advancing member 11′ constitutes the wire guide means.

Figure 4:
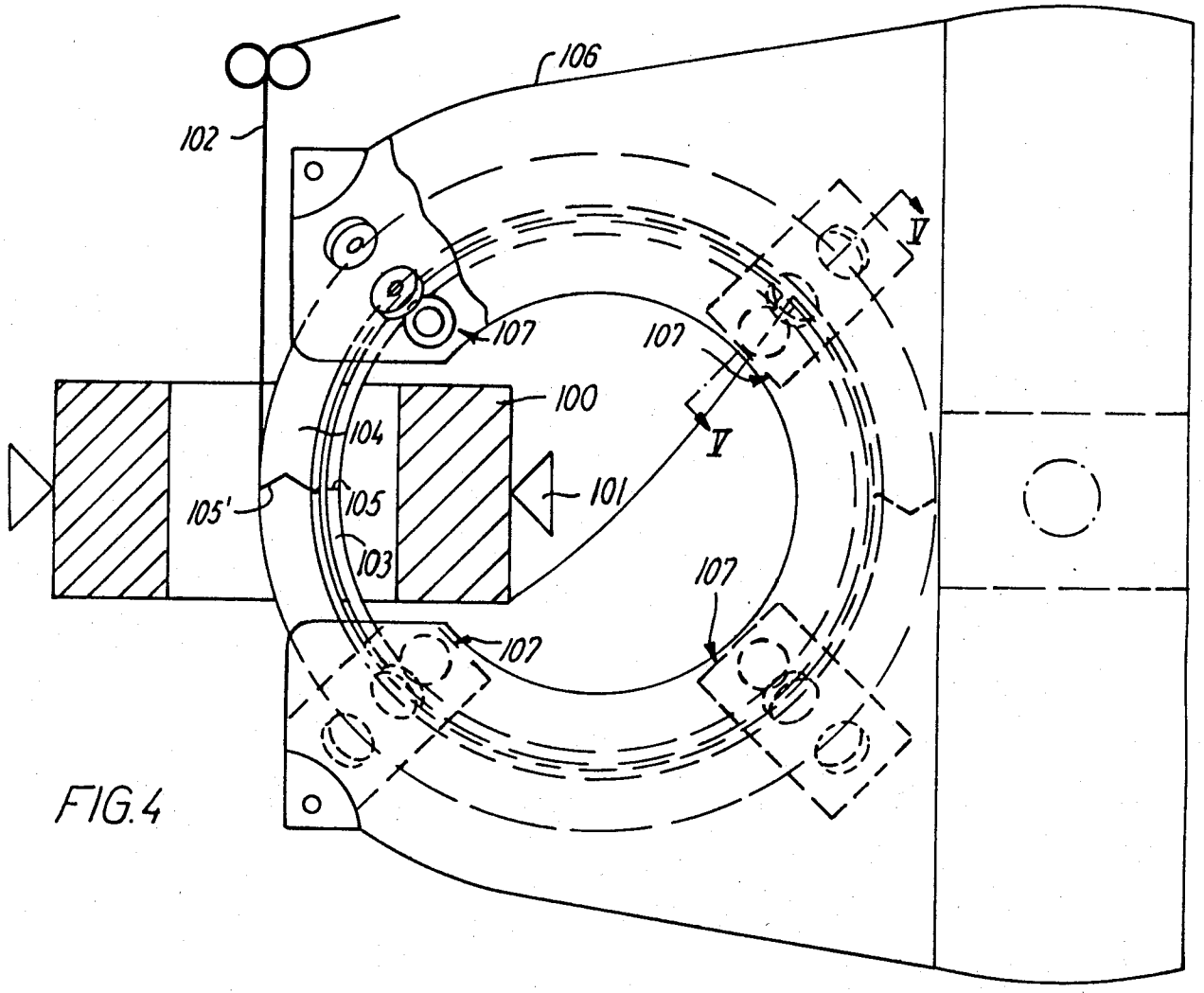
FIG. 4 shows a modification of the winding unit having a substantially closed wire magazine.

In FIG. 4 a modification of the winding unit is shown comprising a wire advancing member 103 of the same design as the wire advancing member 11 in the embodiment in FIGS. 1 and 2 together with a modified wire magazine 104 of the design described in my copending U.S. patent application Ser. No. 269,017 which is incorporated herein by reference.

In this winding unit, a toroidal core 100 guided in guide means 101, which are only schematically shown, is wound with winding wire 102 by means of the rotating wire advancing member 103 and wire magazine 104, each of which is composed of two parts separated by joining faces 105 and 105′, respectively, so that the magazine and the advancing member may be opened along a diameter for positioning and removal of the core 100.

The wire advancing member 103 and the wire magazine 104 are journalled in a cassette 106 which may be coupled exchangeably to the frame of a winding machine comprising driving means for rotation of the wire advancing member 103 as well as operator means for opening and closing two parts of the cassette 106 which are pivotally journalled with each other, whereby also the wire advancing ring 103 and the wire magazine 104 may be opened and closed. The bearing means for journalling the wire advancing member 103 and the wire magazine 104 for rotation independent of each other comprise four common bogie guide assemblies 107 arranged in the cassette 106 with a mutual angular displacement of 90°, at least one of said assemblies 107 comprising transmission means for coupling the wire advancing member with the driving means in the winding machine. Moreover, the bogie guide assemblies 107 in the cassette 106 may comprise means for controlling the tension of the wire 103 drawn out from the magazine 109.

The use of bearing means in the form of bogie guide assemblies for suspension of a rotating wire magazine relative to a cassette which is coupled to a winding machine is described in further detail in my copending U.S. patent application Ser. No. 268,995, now abandoned which is incorporated herein by reference.

Figure 5:
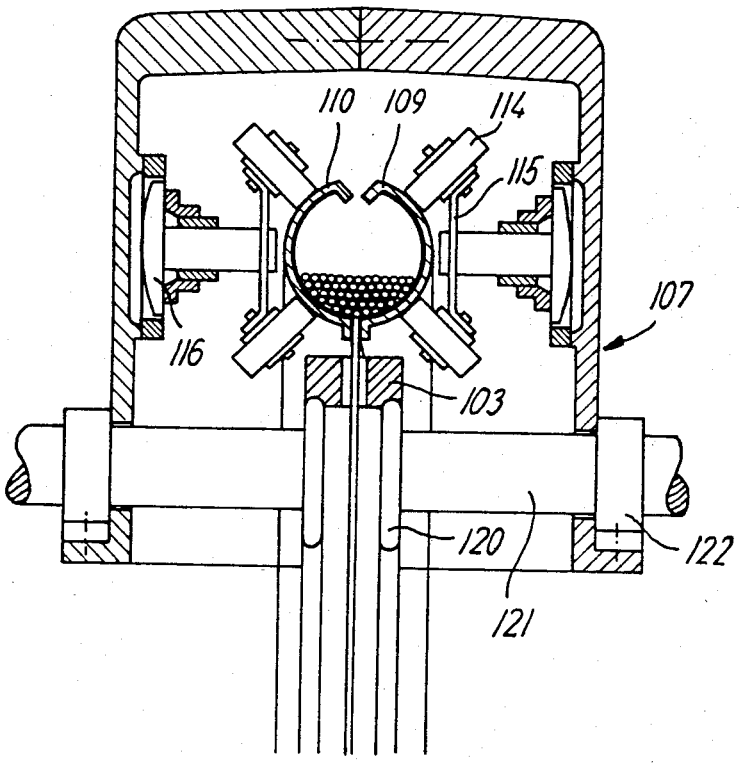
FIG. 5 is a cross-sectional view of the modified embodiment in FIG. 4.

As shown in FIG. 5 the wire magazine 104 comprises two annular halves 109 and 110 each of which is separated by the joining faces 105′ into two semi-annular parts 109*a*, 109*b* and 110*a*, 110*b*. In each of the bogie guide assemblies 107 the wire magazine 104 is supported by four guide rollers 114 pairwise engaging the annular magazine halves 109 and 110 with a mutual angular displacement of 90°, each guide roller 114 being constituted by the outer ring of a ball bearing the inner ring of which is secured to one of two opposed bogie consoles 115. The bogie consoles 115 are displaceably arranged in seats 116 so as to be movable from a rest position in which the guide rollers 114 are retracted from engagement with the magazine halves 109 and 110 to a working position in which supporting engagement is maintained between rollers 114 and magazine 104.

Actuation means for moving the bogie consoles 114 from the rest position to the working position may comprise pneumatic actuators incorporating a piston 117 acting on the bogie consoles 115 and engaged by rubber diaphragms 118 forming walls in pressure chambers 119 in the manner described in the above-mentioned application Ser. No. 268,995.

In the winding unit according to the present invention each of the bogie guide assemblies 107 moreover comprises the individual bearing means for the wire advancing member 103. These bearing means may comprise rollers 102 which in this case are secured on shafts 121 which are journalled independently in fixed bearing consoles 122 in the bogie guide assemblies 107. In at least one of the bogie guide assemblies 107 the shaft 121 may be connected with coupling means in the form of gears or friction rollers engaged by the driving means in the winding machine for rotational drive of the wire advancing member 103.

Figure 6:
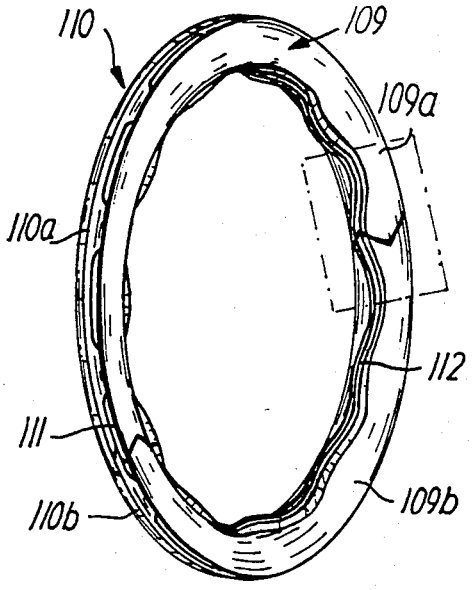
FIG. 6 is a perspective view of an embodiment of the wire magazine in FIG. 4.

As shown more clearly in the perspective view in FIG. 6, the magazine halves 109 and 110 are separated on the side facing away from the axis of revolution of the wire magazine by a wire filling slit 111, whereas on the opposite side facing the axis of revolution, they are separated by a bottom slit 112 for drawing out the winding wire.

For a more detailed illustration of the modified wire magazine reference is made to FIGS. 7 to 10 which show a number of representations of the part of the wire magazine situated within a dashed-line frame in FIG. 6. As shown in the sectional views in FIGS. 9 and 10, taken together with the sectional view in FIG. 5, the magazine halves 109 and 110 are designed with thin walls of a substantially semicircular cross-sectional form to provide a substantially closed storage space 113, the walls of which formed by the halves 109 and 110 are only broken by the bottom slit 112 for drawing out the winding wire and the opposed wire filling slit 111.

Figure 7:
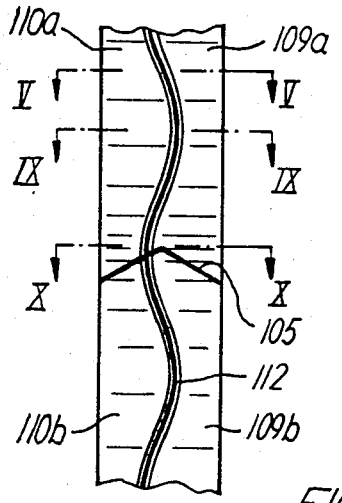
FIG. 7 is an unfolded view of a part of the side of the wire magazine in FIG. 6 facing the axis of revolution.
Figure 8:
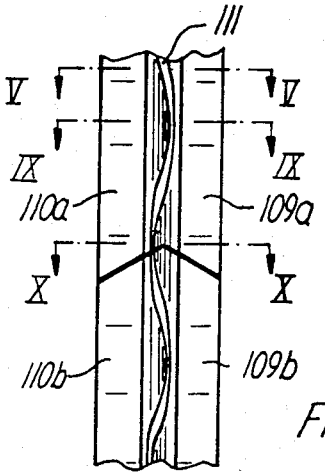
FIG. 8 is an unfolded view of a part of the opposite side of the wire magazine in FIG. 6.

As most clearly apparent from the unfolded view in FIG. 7 of the side of the magazine facing the axis of revolution, the bottom slit 112 is defined by edge portions of the magazine halves 109 and 110 having walls, the surfaces of which deviate from a planar parallel relationship with the symmetry plane of the wire magazine normal to the axis of revolution. In the embodiment shown, said edge portions form flanges 109*c* and 110*c*, respectively, projecting against the axis of revolution, as shown in FIGS. 5, 9 and 10, said flanges extending the radial dimension of the bottom slit 112 to provide a greater friction surface for the winding wire passing through the slit.

As shown in FIG. 7, the non-planar course of the walls of the bottom slit 112 is obtained in the embodiment shown in that the surfaces of said walls, in this case formed by the flanges 109*c* and 110*c*, have a longitudinal wave-form. This wave-form may substantially be a sine-wave, in which the amplitude and frequency are matched to the range of wire dimensions, for which the magazine is to be used, the rotational speed of the magazine, etc.

Figure 9:
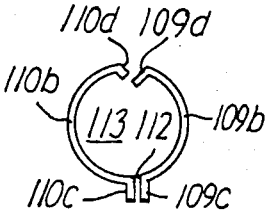
FIG. 9 and 10 are sectional views after the lines IX—IX and X—X in FIGS. 7 and 8, respectively.
Figure 10:
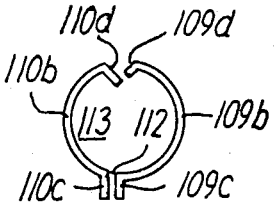

In the embodiment shown, the flanges 109*c* and 110*c* have independent of the wave-form such an angular position relative to the magazine halves 109 and 110 that the walls of the bottom slit 112 are intersected by any radial plane normal to the axis of revolution of the magazine in substantially straight lines which are substantially parallel to the symmetry plane normal to the axis of revolution, such as shown in FIGS. 5, 9 and 10.

In order to facilitate the introduction of winding wire into the magazine, the filling slit 111 is formed as shown in FIGS. 5, 9 and 10 with walls following cone faces which are symmetrical relative to the symmetry plane of the magazine normal to the axis of revolution, said walls of the filling slit being formed by edge portions 109*d* and 110*d*, respectively, of the two magazine halves 109 and 110 bent inwardly towards the storage space 113. An improved closing of the magazine may be obtained also at the filling slit 111 in that the edges of said edge portions 109*d* and 110*d* facing the storage space 113 are designed with tongues. Thereby, the filling slit 111 will show a waveformed course when viewed from the outside, such as shown in FIG. 6, in which the wave forms of the two tongue-shaped edges are in-phase in order to obtain an unrestricted wire introduction and simultaneously the maximum possible closing effect for the wire end after cutting of the winding wire.

In the embodiment shown, the general wave-form of the bottom slit 112 will have as a result that also the mouth of the slit 112 facing the axis of revolution becomes wave-formed. For most practical winding operations, the lateral oscillation of the winding wire in the wiring between the magazine and the toroidal core 101 caused thereby will not play any role.

However, in some winding operations associated particularly with the production of controllable resistors and transformers, it is desired to have the winding made with a greater accuracy, and for this purpose the wire magazine may be designed, so that the mouth of the bottom slit towards the axis of revolution will extend in one and the same plane, i.e. the symmetry plane of the magazine normal to the axis of revolution.

A winding operation performed by a winding unit according to the invention can be described to comprise the following steps:

(a) The wire is carried from the supply roll through the bottom of the magazine to engage the core and is held against the core.

(b) Rotation of the magazine is initiated. Each time a winding has been positioned on the core a corresponding length of wire has been drawn from the wire magazine through the bottom thereof whereby the point of drawing has been subjected to a displacement corresponding to one winding length or a corresponding displacement has occurred between the wire magazine and the guide ring. Simultaneously, the magazine has moved a length corresponding to its own circumference plus the length of a winding, and a corresponding wire length has been supplied to the magazine.

(c) The wire is cut when a sufficient supply for the actual operation has been filled into the magazine, and the winding operation continues with the same direction of rotation until the magazine is emptied.

The winding unit with a wire magazine according to the invention may be used for the winding of wire on an elongate member of any kind whether curved or rectilinear. In particular it is suitable for the winding of cores for electrical coil and transformers such as endless toroidal cores.

I claim:

1. A winding unit for use in a winding machine for the winding of a wire on elongate, particularly closed core members, such as toroidal cores, said winding unit comprising:

suspension means for supporting a core member for rotational movement in a first plane;

a substantially annular wire advancing member;

driving means coupled with said wire advancing member;

first individual bearing means for suspending said wire advancing member for rotational movement in a prescribed direction of revolution around its own axis in a plane substantially normal to said first plane and with a substantially circular path of movement encircling said core member;

a substantially annular wire magazine to provide a storage space for taking up wire from an external supply and having cross-sectional width and height dimensions considerably exceeding the diameter of said wire, said wire magazine having an internal side forming the bottom of said storage space and an external side providing an opening for filling wire into said storage space, said internal side having a diameter exceeding the external diameter of the wire advancing member;

second individual bearing means for suspending said wire magazine coaxially with said wire adcancing member with the internal side of the wire magazine extending in radial alignment with an external side of said wire advancing member throughout the axial width of said wire advancing member;

said first and second bearing means allowing said wire magazine to follow the rotational movement of said wire advancing member in said prescribed direction, but independent of the movement of the wire advancing member;

a bottom slit formed in the internal side of the wire magazine throughout the circumferential length thereof with an opening facing said axis for drawing out wire from said storage space simultaneously with the filling of wire into said storage space through the opening in said external side of the wire magazine;

wire guide means formed on said wire advancing member in substantial radial alignment with said bottom slit; and means at the external side of the wire magazine to close the storage space of the magazine on part of said external side.

2. A winding unit as claimed in claim 1, wherein the wire advancing member is formed in one piece as a substantially annular member having two ends spaced by an interruption, said wire guide member being constituted by one end of said member.

3. A winding unit as claimed in claim 1, wherein said means for closing the storage space of the magazine comprises a braking belt encircling the wire magazine on part of said external side.

4. A winding unit as claimed in claim 1, wherein said first and second bearing means comprise ball bearings between ball races formed in opposing surface portions of the wire magazine and the wire advancing member, respectively.

5. A winding unit as claimed in claim 1, wherein the wire magazine comprises two annular halves, each of which is composed of two semi-annular parts separated by joining faces and formed with thin walls having a substantially semi-circular cross-sectional form to incorporate said means for closing the storage space of the magazine, said two halves being separated, in addition to said bottom slit by an opposite wire filling slit only, said bottom slit being defined by edge portions of said two halves having walls, the surfaces of which deviate from a planar parallel relationship to the symmetry plane of the wire magazine normal to the axis of revolution.

6. A winding unit as claimed in claim 5, wherein said edge portions of said magazine halves form flanges extending towards the axis of revolution for extending the radial dimension of said bottom slit.

7. A winding unit as claimed in claim 5, wherein the walls of the bottom slit have longitudinally wave-formed surfaces.

8. A wire unit as claimed in claim 7, wherein the walls of the bottom slit are intersected by any axial plane through the axis of revolution in substantially straight lines which are mainly parallel to said symmetry plane normal to the axis of revolution.

9. A winding unit as claimed in claim 6, wherein the inlet to said bottom slit facing the supply space of the magazine is longitudinally wave-formed, whereas the edges of said flanges facing the axis of revolution extend in parallel planes normal to the axis of revolution.

10. A winding unit as claimed in claim 5, wherein said filling slit has walls, the surfaces of which follow cone faces which are symmetric around said symmetry plane in the magazine normal to the axis of revolution.

11. A winding unit as claimed in claim 10, wherein the walls of the filling slit are formed by edge portions of said two magazine halves, which are bent inwardly towards the supply space of the magazine.

12. A winding unit as claimed in claim 11, wherein the edges of said edge portions facing said supply space are formed with tongues.

* * * * *